US007468681B2

(12) United States Patent
Bootes

(10) Patent No.: US 7,468,681 B2
(45) Date of Patent: Dec. 23, 2008

(54) DECELERATION WARNING LIGHT ASSEMBLY

(75) Inventor: Todd Bootes, Fort Myers, FL (US)

(73) Assignee: PWC Industries, Inc., Fort Myers, FL (US)

( * ) Notice: Subject to any disclaimer, the term of this patent is extended or adjusted under 35 U.S.C. 154(b) by 0 days.

(21) Appl. No.: 11/973,418

(22) Filed: Oct. 9, 2007

(65) Prior Publication Data

US 2008/0068200 A1 Mar. 20, 2008

Related U.S. Application Data

(63) Continuation-in-part of application No. 11/443,569, filed on May 31, 2006, now abandoned.

(51) Int. Cl.
*G08B 23/00* (2006.01)

(52) U.S. Cl. ..... 340/984; 340/815.45; 114/343

(58) Field of Classification Search ..... 440/2; 114/145 R, 145 A, 343, 364; 362/477; 340/479, 340/463, 467, 815.45, 984; 701/21, 70, 72
See application file for complete search history.

(56) References Cited

U.S. PATENT DOCUMENTS 3,601,564 A * 8/1971 Ellison ..... 200/61.48
5,603,644 A * 2/1997 Kobayashi et al. ..... 440/86
6,856,884 B2 * 2/2005 Traylor ..... 701/70

* cited by examiner

*Primary Examiner*—Ed Swinehart
(74) *Attorney, Agent, or Firm*—William E. Noonan

(57) ABSTRACT

A warning light assembly for a watercraft or land vehicle includes a selectively activatable light for mounting to the watercraft or vehicle such that the light is clearly visible to nearby operators/drivers. There is a power source for being carried by the watercraft/vehicle. The light is operatively connected to the power source through a switch that is alternatable between open and closed states. At least one mechanism is provided for sensing when the watercraft/vehicle is decelerating. A control device is responsive to the sensing mechanism for closing the switch only when the watercraft/vehicle decelerates in a longitudinal direction and simultaneously there is no change in acceleration in a transverse direction. This causes the light to activate so that a deceleration warning is provided to nearby persons.

11 Claims, 3 Drawing Sheets

DECELERATION WARNING LIGHT ASSEMBLY

RELATED APPLICATION

Figure 1A:
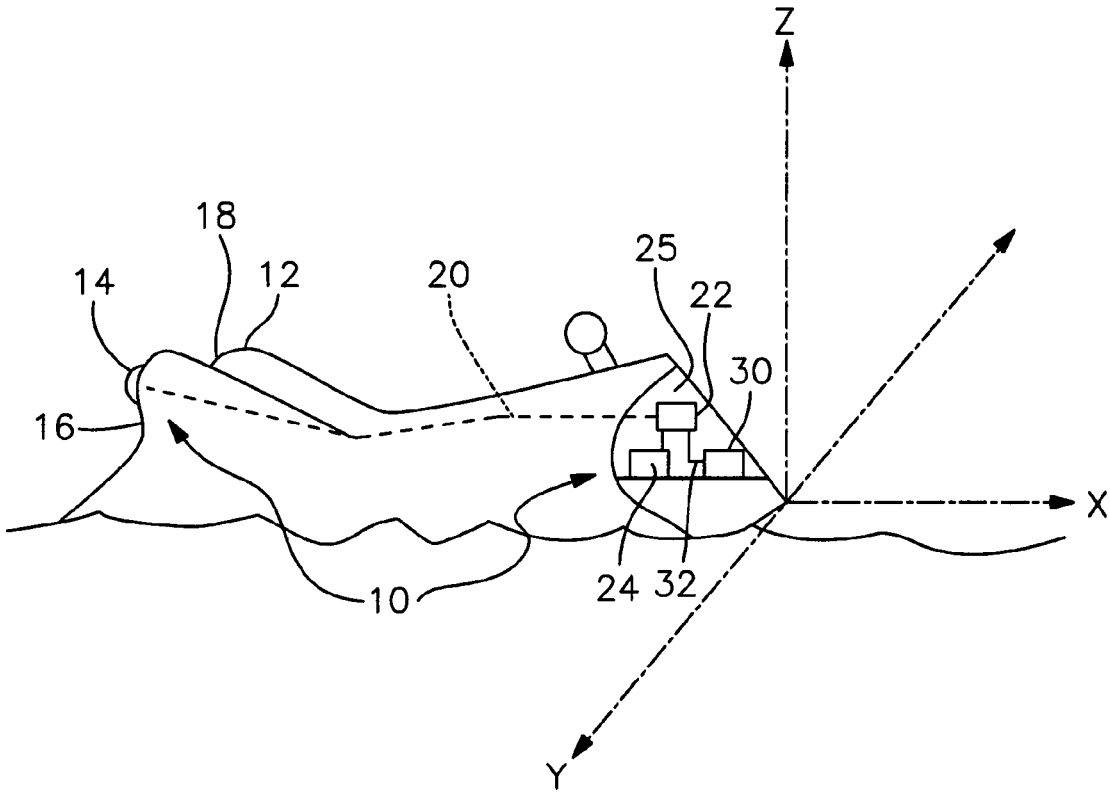

This application is a continuation in part of U.S. patent application Ser. No. 11/443,569 filed May 31, 2006 now abandoned.

FIELD OF THE INVENTION

This invention relates to warning lights for a personal watercraft or other marine vessels. The light may also be employed by motorcycles, ATV's and other sports or recreational land vehicles. More particularly, the invention relates to a warning light assembly that is activated to indicate that the vessel or vehicle has decelerated.

BACKGROUND OF THE INVENTION

Personal watercraft and similar types of boats and marine vessels are able to accelerate, decelerate and change speeds quite suddenly. This can create an extremely dangerous situation. If the operator of a neighboring vessel is unaware that a personal watercraft is slowing down, the neighboring operator may be unable to take timely corrective action. Dangerous and potentially deadly collisions often result. Colliding watercraft are apt to incur significant damage and require expensive repairs.

The present invention helps to reduce the forgoing problem by providing a personal watercraft or other marine vessel with warning lights that are activated whenever the vessel decelerates. Although various declaration warning lights are already known for motor vehicles, these devices invariably require that the vehicle must first slow to a threshold speed before the warning light is activated. None of the known devices activates the light virtually instantaneously and simultaneously with the commencement of deceleration. A much faster and more immediate warning is required, especially for personal watercraft, as well as for land based vehicles such as motorcycles and ATV's where sudden deceleration can present the risk of a serious collision almost instantly.

Conventional deceleration based warning lights are also inadequate for personal watercraft, motorcycles, ATV's and the like because of the severe inertial forces (g-forces) exerted in various directions on such vessels and vehicles while they are operated in a typical sporting or intense recreational environment. On the water, waves and rough conditions tend to exert vertical acceleration forces upon the watercraft while it moves forwardly. Such forces are likewise exerted on motorcycles and ATVs by bumps and uneven road conditions. By the same token, lateral g-forces are exerted on such vessels and vehicles as they turn. These vertical and lateral forces tend to inherently contribute to at least some forward deceleration. Although I have determined that it is generally desirable to activate a warning light instantaneously upon any forward deceleration, I have also determined it would be annoying, inconvenient and potentially dangerous for such lights to be automatically activated when the forward deceleration is caused by spurious vertical and lateral g-forces as described above. This would result in an almost constant flashing of the warning light during operation of the vessel or vehicle over a rough or bumpy water or land surface, or during turning. This would be quite distractive to nearby watercraft operators and vehicle drivers. In order for a deceleration warning light for personal watercraft, motorcycles, ATVs and the like to be practical it must eliminate the foregoing problem.

SUMMARY OF THE INVENTION

It is therefore an object of the present invention to provide warning lights for a personal watercraft or other marine vessel, which immediately, effectively and reliably warn surrounding vessels that the watercraft equipped with the lights is braking or otherwise decelerating in a forward direction.

It is a further object of this invention to provide a watercraft warning light assembly that significantly improves watercraft safety and reduces the risk of death, injury and property damage commonly caused by watercraft collisions.

It is a further object of this invention to provide a warning light for a marine vessel or land vehicle that activates immediately upon forward deceleration not caused by lateral g-forces and which does not require deceleration to a threshold level in order to operate.

It is a further object of this invention to provide for a deceleration sensor for a marine watercraft and land vehicles that effectively ignores spurious signals generated by transverse acceleration or g-forces and which activates warning lights only when deceleration is sensed in a forward direction exclusively.

It is a further object of this invention to provide a marine vessel and vehicular warning light assembly that avoids constant, distracting and misleading flashing resulting from the sensing of g-forces transverse to the direction of travel and which therefore operates safely and reliability to warn surrounding boaters or drivers that the watercraft or vehicle equipped with the lights is decelerating in the forward direction.

This invention results from a realization that the risk of a collision between watercraft can be significantly reduced by employing a warning light assembly which enables a decelerating watercraft to advise surrounding watercraft that it is decelerating almost immediately and without requiring a threshold deceleration. The invention results from my further realization that if used in sport or recreational applications such as on personal watercraft or motorcycles, conventional deceleration responsive warning lights will generate spurious, disruptive and potentially dangerous warning signals unless the apparatus is specifically designed to compensate for the acceleration or g-forces that are exerted along one or more axes transverse to the longitudinal axis corresponding to the forward direction of travel. The present invention provides for such compensation and also features activation of the warning light instantaneously upon sensing of deceleration in the forward direction in circumstances where simultaneously where there is no change in acceleration transversely to the direction of travel. Such a warning light assembly is especially safe and effective for use on personal watercraft, motorcycles, ATVs and other types of sporting marine vessels and land vehicles.

This invention features a warning light assembly for a watercraft. A selectively actuable light is mounted to the watercraft for viewing by persons in nearby watercraft. A light is attached to a source of power by a switch. In a closed condition, the switch connects the power source to the light to activate the light. When the switch is open, the light is disconnected from the battery and the light is deactivated. There is a sensor mechanism for detecting change in acceleration of the watercraft along a primary longitudinal axis corresponding to a forward direction in which the vessel is traveling and a secondary axis transverse to the primary axis. A control device, responsive to the sensor mechanism, closes the switch only when the watercraft is decelerating along the primary longitudinal axis while simultaneously there is no sensed change in the acceleration along the secondary axis. This causes the lights to be activated to provide an indication that the watercraft is decelerating.

In a preferred embodiment, the light is attachable to the transom or other rearward facing portion of the watercraft. The sensor may include a decelerometer, tachometer, speedometer, accelerometer, potentiometer or other device for sensing the change in acceleration or speed of the watercraft.

The control device may include a microprocessor that receives acceleration signals from the sensor mechanism. The switch may include an electronic switch that responds to signals from the control device indicating that the watercraft is being decelerated. When such signals are received, the switch is closed to provide power and thereby activate the lights. The power source may include a battery. The sensor and the power source may be mounted at various locations within the watercraft. Various types of lights, including but not limited to LEDs, may be utilized.

The warning light assembly may also be employed on land based vehicles. It is particularly effective for use on motorcycles, ATVs and other sport or recreational vehicles where significant acceleration or g-forces are exerted vertically and otherwise transversely to the direction of travel.

DETAILED DESCRIPTION OF PREFERRED EMBODIMENTS

Figure 1B:
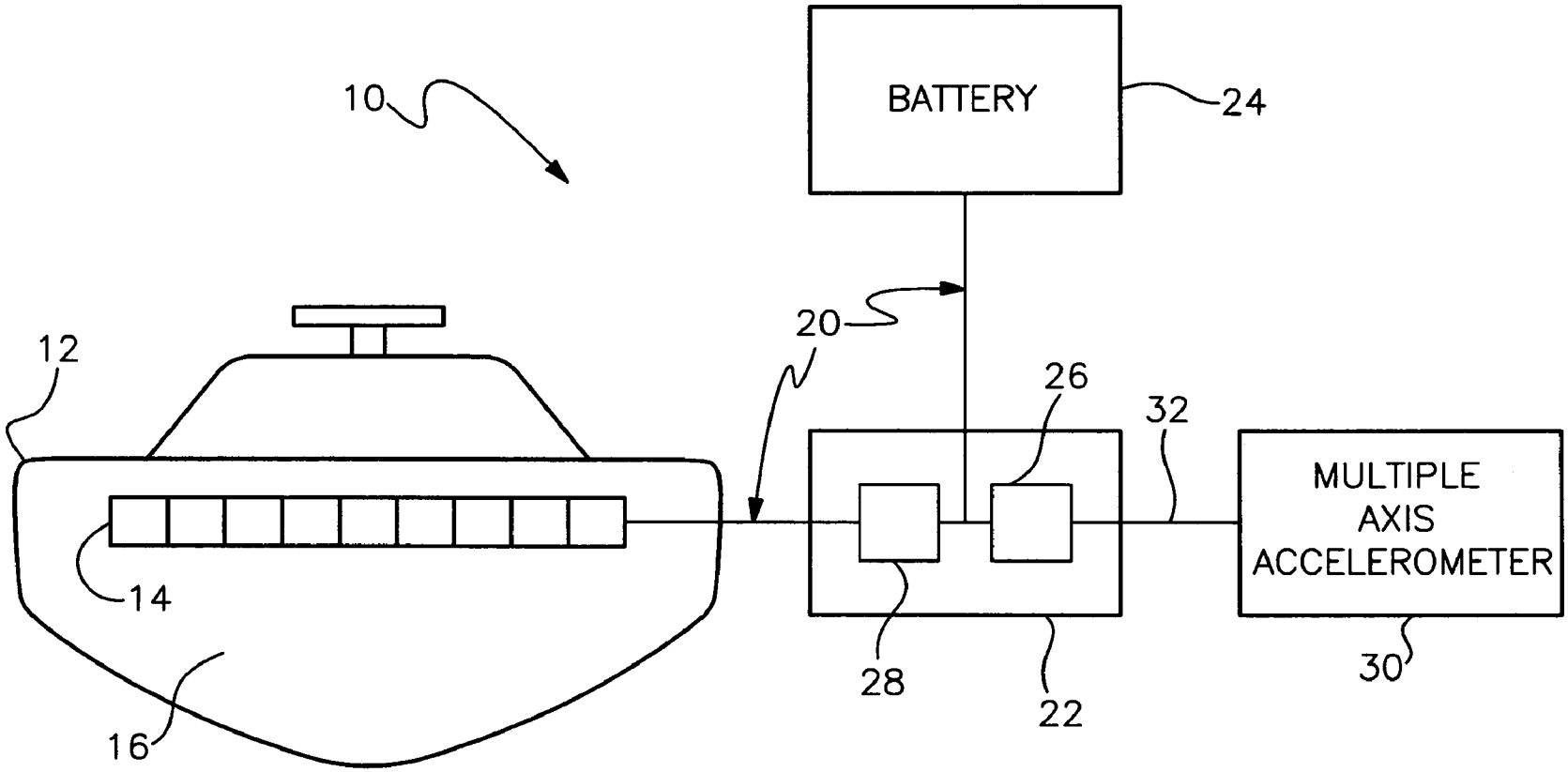
Figure 2:
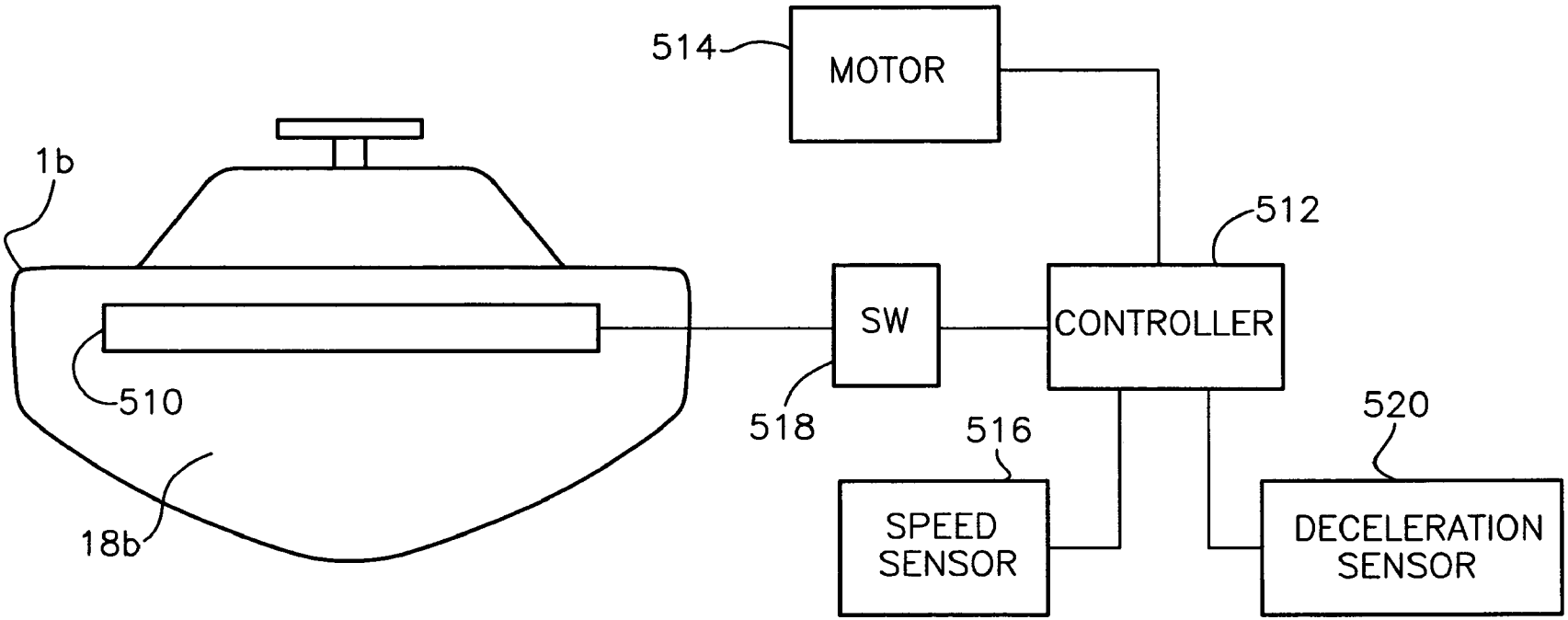

Other objects, features and advantages will occur from the following description of a preferred embodiment and the accompanying drawings, in which:

FIG. 1A is a perspective and partially graphic and cut-away view of a personal watercraft that is equipped with the deceleration warning light system in accordance with this invention;

FIG. 1B is an elevational and partly schematic view of the preferred version of the warning light assembly wherein a multiple axis accelerometer provides acceleration signals to an electronic controller that selectively activates the warning light when predetermined conditions are met; and FIG. 2 is an elevational and partly schematic view of an alternative preferred embodiment wherein various electronic sensors are employed to detect deceleration of the watercraft and further wherein an electronic controller responds to deceleration signals to activate the warning light.

There is shown in FIGS. 1A and 1B a personal watercraft 12 that is equipped with a warning light assembly 10 in accordance with this invention. In the versions depicted herein, the warning light assembly is shown in conjunction with a personal watercraft. However, it should be understood that the assembly may be employed equally advantageously on various other types of marine vessels, as well as land vehicles. The warning light assembly is particularly effectively for use on motorcycles, all terrain vehicles (ATVs) and other vehicles utilized extensively for sport or other recreational applications wherein the vehicle is subjected to acceleration, inertial or g-forces along multiple axes of movement. As used herein, "vehicle" should be understood to refer to any and all types of land and marine based vehicles and vessels.

A warning light 14 is mounted to a rearward end portion or stern 16 of watercraft 14. It should be understood that the light may be mounted to a transom of the watercraft or alternatively to the rearwardly facing portion 18 of seat 12. Light 14 may be mounted at any location on or proximate stern 16 that is clearly visible to trailing or otherwise nearby boaters and watercraft users. Light 14 may comprise red LED strip lights or various other known types of lights that are easy for persons and surrounding vessels to recognize. The warning light may be mounted to the transom, seat or other portion of the stern by various known means of attachment such as bolts, screws, clamps, brackets and/or adhesive. The warning light is electrically connected by wiring 20, shown in phantom in FIG. 1A, through a lighting control mechanism 22 to a battery 24. As best illustrated in FIG. 1A, the battery and control circuit are mounted within a forward compartment 25 of watercraft 12. These components may be secured within compartment 25 by appropriate clips, brackets and holders in various selected locations. It should be understood that the battery and control circuit may be located at various alternative locations within the body of the personal watercraft.

As is depicted more specifically in FIG. 1B, control circuit 22 (which is typically mounted on a mother board) carries a microprocessor 26 and an electronic switch 28, which is interconnected between the microprocessor and warning light 14. Circuit 22 also includes various other conventional electronic components and circuitry that will be understood to persons skilled in the art. By the same token, battery 24 is connected to control circuit 22 in a conventional manner. The control circuit functions such that the microprocessor operates switch 28 according to programmed instructions so that the control circuit provides electrical power through the switch to activate warning light 14 when predetermined conditions are sensed in accordance with this invention. This operation is described more fully below.

Input signals representing changes in the watercraft's acceleration are provided to microprocessor 26 of control circuit 22 by a multiple axis accelerometer 30. Accelerometer 30 is mounted within compartment 25 of watercraft 12 proximate the bow of the watercraft. See FIG. 1A. Alternative locations may be utilized within the watercraft for mounting the accelerometer. As depicted graphically in FIG. 1A, the accelerometer senses changes in the vessel's deceleration along multiple axes x, y and z. Axis x comprises a primary axis, which corresponds to the forward, longitudinal direction in which watercraft 12 travels. Axes y and z represent respective secondary axes, which are transverse to primary axis x. More particularly, axis y represents lateral motion of the watercraft, specifically while it is turning. Axis z is a vertical axis representing vertical motion of watercraft 12 as it encounters waves, ripples and other disturbances on the horizontal surface of the water.

Acceleration, inertial or g-forces are exerted upon the watercraft as it travels through a body of water. Various types of multiple-axis accelerometers are preferably utilized to detect changes in acceleration of watercraft 12 along the x, y and z axes. In alternative embodiments, accelerometer 30 may sense changes in acceleration along only a single transverse axis (e.g. either y or z). In all cases, the changes along longitudinal axis x must be sensed. Although various accelerometer constructions, which will be known to persons skilled in the art, may be employed, a preferred device is a dual axis accelerometer manufactured by U.S. Logic Corp.

Accelerometer 30 is connected through line 32 to an input of microprocessor 26. Control circuit 22 is mounted on a circuit board, on which, as previously indicated, may be mounted at various locations within the compartment or elsewhere within watercraft 12. The board and the electronic components it carries are assembled, wired and energized in a manner that will be known to persons skilled in the art.

Microprocessor 26, FIG. 1B, is programmed using conventional programming techniques, so that the warning light 14 is activated only when predetermined conditions or parameters are sensed by accelerometer 30. In order to direct the electronic switch to activate the light, it is critical that two specific conditions be met: (1) the multiple-axis accelerometer 30 must sense that the watercraft is decelerating in the forward direction along axis x and (2) accelerometer 30 must simultaneously sense no change in the acceleration or g-forces along transverse axes y and z. If accelerometer 30 senses that the watercraft is decelerating along axis x, but there is also a change in acceleration sensed along either axis y or z axis, this indicates that the watercraft is decelerating in the forward direction at least partly due to the transverse (vertical and/or lateral) forces exerted upon the watercraft. For example, if the watercraft encounters waves or ripples, it will be pushed to move vertically along axis Z. There is a resultant change in acceleration along that axis. By the same token, as the watercraft turns, a lateral component of acceleration is exhibited along axis y. These movements tend to inherently cause some slight degree of deceleration along axis x. However, they occur so frequently during typical movement of watercraft 12, that it would be undesirable for each such exertion of transverse force and resulting change in acceleration along a transverse axis to result in activation of warning light 14. If this occurred, the warning light would flash on and on repeatedly and virtually incessantly. This could cause a particular problem, for example, if the vessel is traveling through choppy seas. Even when the operator does not use the throttle to decelerate, the forward deceleration resulting from the transverse (lateral and vertical) g-forces would cause unwanted and annoying activation of the warning light. In certain cases this could constitute a danger to surrounding vessels and operators who are distracted by or confused about the warning light's sudden, frequent or erratic operation.

The foregoing difficulty is overcome by programming microprocessor 26 so that the microprocessor maintains switch 28 essentially in an open condition to deactivate the warning light whenever accelerometer 30 senses a change in acceleration or an exertion of g-force in a transverse direction relative to watercraft 12 (e.g. along axes y or z). Only when accelerometer 30 senses no such change in acceleration along a transverse axis and deceleration is simultaneously sensed along the longitudinal x-axis does microprocessor close switch 28. This causes power to be delivered from the battery through circuit 22 and line 20 to light 14. The light is then activated to advise surrounding boaters that watercraft 12 is decelerating and that such deceleration is due exclusively to a change (decrease) in acceleration of the vessel along the x-axis.

The warning light is especially effective to indicate that a personal watercraft or other vessel is being decelerated by means other than braking. For example, a lighted warning is extremely useful in situations where the throttle is operated so that the vessel is slowed. In the absence of transverse g-forces, the warning light is activated instantaneously to provide a reliable warning signal to others.

As shown in the slightly different version of FIG. 2, personal watercraft 1*b* includes a warning light 510 that is mounted to the transom 18*b* of the vessel as previously described. The light may again be mounted to the rear of the seat or elsewhere on the stern. A microprocessor or other type of electronic controller 512 is mounted within the vessel. This controller accepts signals from one or more speed sensing components of the vessel such as the motor 514 and/or a speedometer 516. A conventional acceleration/deceleration sensor 520 comprising an accelerometer, decelerometer, tachometer, speedometer, throttle, potentiometer or the like, may deliver to the controller signals reflecting the increase in g-forces or otherwise indicating that the watercraft is decelerating along the longitudinal x-axis. In some cases, as in the prior version, a multiple axis acceleration sensor may be employed. Alternatively, if the forward (x-axis) deceleration signal is provided by a speedometer, tachometer, motor, etc., a separate inertial/g-force sensor or accelerometer should be provided for sensing changes in acceleration along one or more axes transverse to the x-axis (e.g. the vertical z-axis and/or the lateral y-axis). In such cases, this sensor is represented by acceleration sensor 520.

In one preferred version, a decelerometer, controller and switch are mounted on a circuit board that is installed in the hull of the vessel. The board and components it carries are assembled, wired and energized in a manner that will be known to persons skilled in the art. The controller is programmed in a known manner such that when the pertinent sensor determines that the speed of the vessel has been reduced through either a reduction in the speed in the motor, a corresponding reduced speed signal from the speedometer, and/or a deceleration signal from the sensor 520, the controller closes an electronic switch 518, which in turn energizes warning light 510. The switch 518 itself is connected to a power source, such as a battery (not shown), by conventional means as previously described. As in the prior embodiment, the switch and microprocessor may be integrated in a circuit carried on a mother board or the like.

In the foregoing manner, whenever the speed of the vessel decreases and such deceleration is not due to transverse changes in acceleration, the warning light 510 is activated and surrounding vessels are warned to take corrective action as necessary. Whenever the vessel is accelerating or traveling at a constant speed, the switch 518 is held open and light 510 is deactivated.

In alternative embodiments, the warning light may be mounted to a land vehicle such as a motorcycle or ATV. The deceleration sensor and control circuit are installed in an accessible and convenient location on the frame or chassis of the vehicle. The warning light is mounted to a rear fender, the rear of a seat or otherwise on the chassis such that it faces rearwardly. Wiring that attaches the control circuit to the light is also secured to the chassis. The vehicle's battery is the power source. Otherwise, the structure and operation of the warning light are analogous to those in the watercraft version described above. The controller is again programmed to disregard forward deceleration caused in part by transverse g-forces, which are caused, for example, by bumps or unevenness in the driving surface or rapid turning of the vehicle. The light is activated only when slowing is caused by deceleration in the longitudinal, forward direction of travel.

From the foregoing it may be seen that the apparatus of this invention provides for a deceleration warning light for a personal watercraft or other marine vessel or land vehicle. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A warning light assembly for a watercraft, said assembly comprising:

a selectively activatable light for mounting to the watercraft such that said light is clearly visible to persons in nearby watercraft;

a power source for being carried by the watercraft, said light being operatively connected to said power source through a switch that is alternatable between open and closed states;

a sensor that detects changes in acceleration of the watercraft along a primary axis corresponding to a forward longitudinal direction in which the watercraft is traveling and along a secondary axis transverse to said primary axis; and a controller, responsive to said sensor, said controller closing said switch to operate said light only when said sensor detects that the watercraft is decelerating in the forward direction along said primary axis while simultaneously detecting no change in the acceleration of the watercraft along the secondary axis.

2. The assembly of claim 1 in which said light is mountable to a rearwardly exposed section of the watercraft.

3. The assembly of claim 1 in which said light includes a plurality of LEDs.

4. The assembly of claim 1 in which said switch includes an electronic switch.

5. The assembly of claim 1 in which said power source includes a battery.

6. The assembly of claim 4 in which said controller includes a microprocessor for opening and closing said switch in response to receiving a respective predetermined signal input from said means for sensing.

7. The assembly of claim 1 in which said sensor includes an accelerometer for measuring the g forces exerted upon the watercraft.

8. A warning light assembly for a vehicle, said assembly comprising:

a selectively activatable light for mounting to the vehicle such that said light is clearly visible to persons in nearby vehicle;

a power source for being carried by the vehicle;

a sensor that detects changes in acceleration of the vehicle along a primary axis corresponding to a forward direction in which the vehicle is traveling and along a secondary axis transverse to said primary axis; and a warning light control circuit, responsive to said sensor, said warning light control circuit activating said light only when said sensor detects that the vehicle is decelerating in the forward direction along said primary axis while simultaneously detecting no change in the acceleration of the vehicle along the secondary axis.

9. The assembly of claim 8 in which said sensor includes a multiple axis accelerometer that senses the changes in acceleration, said warning light control circuit including an electronic switch and a microprocessor that is programmed to close said switch and activate said light when the vehicle decelerates along said primary access while simultaneously detecting no sensed change in acceleration of the vehicle along the secondary axis.

10. A warning light assembly for a watercraft, said assembly comprising:

a selectively activatable light for mounting to the watercraft such that said light is clearly visible to persons in nearby watercraft;

a power source for being carried by the watercraft;

a sensor that detects changes in acceleration of the watercraft along a primary axis corresponding to a forward direction in which the watercraft is traveling and along a secondary axis transverse to said primary axis; and a warning light control circuit, responsive to said sensor, said warning light control circuit activating said light only when said sensor detects that the watercraft is decelerating in the forward direction along said primary axis while simultaneously detecting no change in the acceleration of the watercraft along the secondary axis.

11. The assembly of claim 10 in which said sensor includes a multiple axis accelerometer that senses the changes in acceleration of said watercraft along said primary and secondary axes, said warning light control circuit including an electronic switch and a microprocessor that is programmed to close said switch to activate said light when the watercraft decelerates along said primary axis while simultaneously there is no sensed change in the acceleration of the watercraft along the secondary axis.

* * * * *